US007993245B1

(12) United States Patent
Dorfman

(10) Patent No.: US 7,993,245 B1
(45) Date of Patent: Aug. 9, 2011

(54) EXERCISE DEVICE FOR PULL-UPS AND HANGING

(76) Inventor: John Miles Dorfman, Evanston, IL (US)

( * ) Notice: Subject to any disclaimer, the term of this patent is extended or adjusted under 35 U.S.C. 154(b) by 0 days.

(21) Appl. No.: 12/848,106

(22) Filed: Jul. 31, 2010

(51) Int. Cl.
*A63B 1/00* (2006.01)

(52) U.S. Cl. ..... 482/40; 482/148; 482/904

(58) Field of Classification Search ..... 482/38, 482/39, 40, 41, 42, 139, 148, 904; 16/82, 16/402; 292/262; 223/85; 211/105.1, 105.2, 211/153, 175; 248/121, 200, 205.1, 205.4, 248/226.11, 224.8, 220.21
See application file for complete search history.

(56) References Cited

U.S. PATENT DOCUMENTS

| | | | | | |
|---|---|---|---|---|---|
| 1,973,448 | A | | 9/1934 | Steen | |
| 2,637,555 | A | | 5/1953 | Klaudt | |
| 2,714,525 | A | * | 8/1955 | Kessler | 296/135 |
| D210,469 | S | * | 3/1968 | Sejersen | D21/691 |
| 3,430,953 | A | | 3/1969 | Teetor | |
| 3,593,996 | A | | 7/1971 | Thompson | |
| 3,915,452 | A | | 10/1975 | Winblad | |
| 4,014,072 | A | * | 3/1977 | Schumacher | 16/95 R |
| 4,019,764 | A | * | 4/1977 | Okamura | 292/288 |
| 4,591,148 | A | * | 5/1986 | Slater | 482/140 |
| 5,180,350 | A | | 1/1993 | Thomas | |
| 5,259,520 | A | * | 11/1993 | Roggio et al. | 211/105.1 |
| 5,288,257 | A | * | 2/1994 | Zacherl | 446/72 |
| 5,407,414 | A | * | 4/1995 | Bass | 482/129 |
| 5,417,628 | A | | 5/1995 | Vanderbleek | |
| D367,421 | S | * | 2/1996 | Powers | D8/402 |
| D379,299 | S | * | 5/1997 | Fitzgibbons | D8/402 |
| 5,752,903 | A | * | 5/1998 | Chang | 482/141 |
| 5,829,391 | A | * | 11/1998 | Krietzman et al. | 119/708 |
| 5,839,994 | A | | 11/1998 | Elbogen | |
| 5,957,819 | A | * | 9/1999 | Cortesi | 482/121 |
| D436,782 | S | * | 1/2001 | Rapp | D6/574 |
| 6,179,748 | B1 | | 1/2001 | Barr | |
| 6,220,988 | B1 | | 4/2001 | Williams | |
| 6,550,828 | B2 | * | 4/2003 | Warden | 292/288 |
| 6,655,538 | B2 | * | 12/2003 | Saulnier-Matteini | 211/153 |
| D513,171 | S | * | 12/2005 | Richardson | D8/394 |
| 7,503,533 | B1 | * | 3/2009 | Sammann et al. | 248/200 |
| 7,534,197 | B1 | | 5/2009 | Harbers, Jr. | |
| 2005/0250619 | A1 | * | 11/2005 | Daikeler et al. | 482/40 |
| 2009/0256334 | A1 | * | 10/2009 | Handel | 280/612 |

FOREIGN PATENT DOCUMENTS

| | | | |
|---|---|---|---|
| GB | 2177156 | A * | 1/1987 |
| GB | 2190135 | A * | 11/1987 |
| GB | 2299520 | | 9/1996 |

* cited by examiner

*Primary Examiner* — Loan H. Thanh
*Assistant Examiner* — Daniel Roland

(57) ABSTRACT

One embodiment of an exercise device placed on top of a door (122) and of the type having an elongated body (102) which has a half circular profile. A base sheet (106) is attached to the base surface (104) of the elongated body (102) and a top sheet (108) is attached to the curved surface (100) of the elongated body (102) such that it drapes past both long edges of the elongated body (102). A primary end sheet (112) is attached to one end of the elongated body (102). The user places the exercise device on the top of a door with the base sheet (106) contacting the door and the primary end sheet (112) contacting the upper sill (118). The user (120) grabs the top sheet (108) in the area of the curved surface (100) and performs a pull-up or hangs freely.

18 Claims, 7 Drawing Sheets

EXERCISE DEVICE FOR PULL-UPS AND HANGING

BACKGROUND

From time to time, people may perform various physical exercises. Pull-ups are one exercise a person might perform to help strengthen the upper body. Pull-ups may involve a person grabbing some sort of implement overhead with both hands. The person may then pull their chin up to the tops of their hands. Then the person may straighten their arms to lower their body. This may be repeated as many times as desired.

DRAWING DESCRIPTION

DRAWINGS

Reference Numerals

Figure 1:
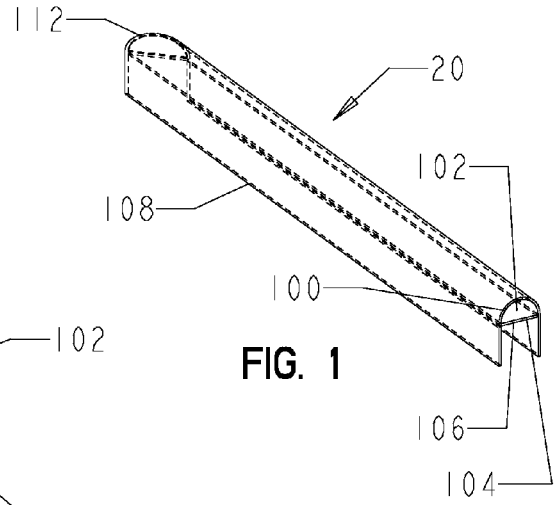
FIG. 1 is a perspective view of the exercise device in accordance with one embodiment.
Figure 2:
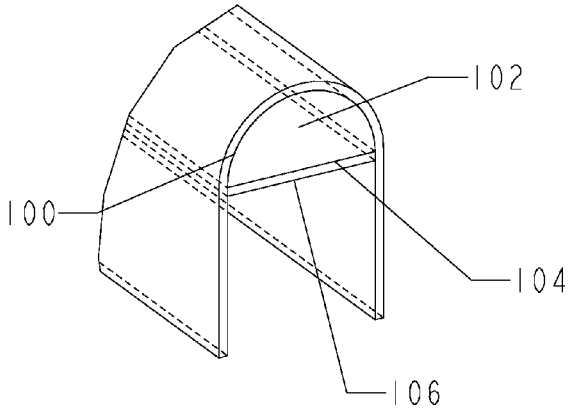
FIG. 2 is an enlarged fragmentary view showing one end of FIG. 1.
Figure 3:
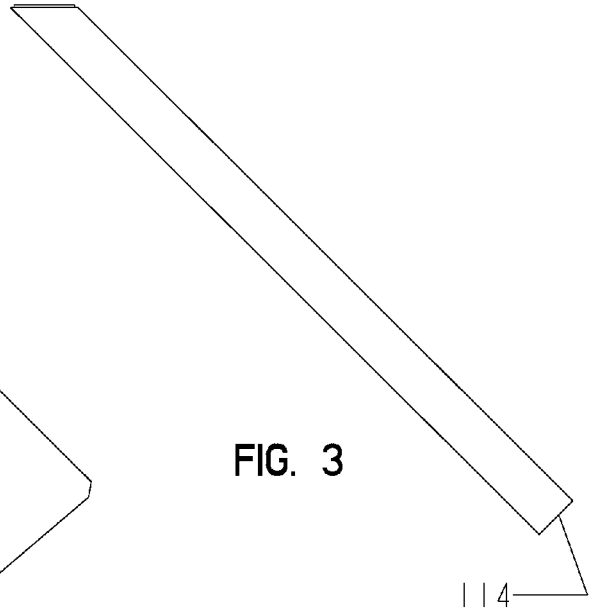
FIG. 3 is a top orthographic view of the exercise device of FIG. 1 showing the angle of one end.
Figure 4:
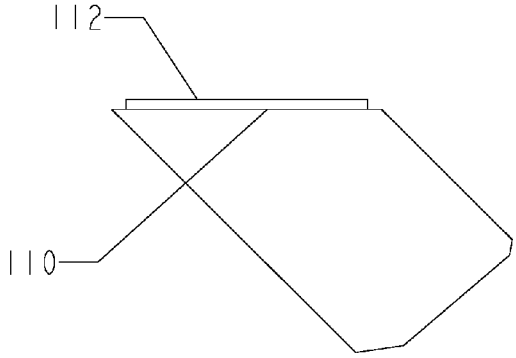
FIG. 4 is an enlarged fragmentary view showing one end of FIG. 3.

| | |
|---|---|
| 20 | exercise device |
| 100 | curved surface |
| 102 | elongated body |
| 104 | base surface |

-continued

| | |
|---|---|
| 106 | base sheet |
| 108 | top sheet |
| 110 | primary end |
| 112 | primary end sheet |
| 114 | secondary end |
| 116 | doorway |
| 118 | upper sill |
| 120 | user |
| 122 | door |
| 150 | flat surfaces |
| 152 | small surfaces |
| 154 | planar surfaces |
| 156 | lesser surfaces |
| 200 | elongated member sheet |
| 202 | elongated member |
| 204 | mating surface |
| 206 | far surface |
| 208 | bottom surface |
| 300 | secondary end sheet |
| 302 | opposite hinged door |

DETAILED DESCRIPTION

FIGS. 1-8

First Embodiment

One embodiment of the exercise device 20 is illustrated in FIGS. 1-4. The exercise device 20 has an elongated body 102. The elongated body 102 is a long straight body extruded with a small profile. The small profile is a generally curved edge connected to a generally straight edge. The elongated body 102 has a primary end 110. The primary end 110 is cut at approximately a 45° angle to the small profile. The primary end 110 to small profile angle could be 5° to 90°. Also, the primary end 110 is approximately normal to a base surface 104 of the elongated body 102. Further, the elongated body 102 has a secondary end 114. The secondary end 114 is cut approximately parallel to the small profile. The secondary end 114 to small profile angle could be 5° to 90°. Also, the secondary end 114 is approximately normal to the base surface 104. A base sheet 106 is fastened to the base surface 104 of the elongated body 102. The base sheet 106 covers approximately the entire base surface 104. A top sheet 108 is fastened to a curved surface 100 on the elongated body 102. The top sheet 108 approximately covers the entire curved surface 100. The top sheet 108 could cover part of the curved surface 100. Also, the top sheet 108 extends beyond the curved surface 100 on the long edges by approximately 1.5 inches. The top sheet 108 could extend beyond the curved surface 100 on the long edges by 0.25, 0.5, 1, 1.5, 2, and 3 inches. The top sheet 108 could extend beyond the curved surface 100 on the long edges from 0 to 10 inches. A primary end sheet 112 is fastened to the primary end 110 of the elongated body 102. The primary end sheet 112 has an approximate profile that matches the profile of the primary end 110 when fastened thereon.

In this embodiment, the elongated body 102 is a half cylinder. A standard 1½ inch diameter wood dowel approximately 2 feet long is cut in half lengthwise to fabricate the half cylinder. The actual diameter of a standard 1½ inch diameter wood dowel is approximately 1⅜ inches. However, the elongated body 102 can be comprised of any stiff material. The stiff material could be, but not limited to: a metal or metal alloy, a ceramic, a porous ceramic, a composite, wood, or plastic. The metal or metal alloy could be, but not limited to: cast iron, low alloy steel, high alloy steel, brass, aluminum, titanium, zinc, and magnesium. Metal fabrication can be, but not limited to, die casting, extruding, and machining. The ceramic could be, but not limited to: silicon, alumina, and zirconia. The porous ceramic could be, but not limited to: concrete, brick, glass, and porcelain. The composite could be, but not limited to: carbon-fiber reinforced plastic and glass-fiber reinforced plastic. The wood could be, but not limited to: pine, oak, maple, oak, medium-density fiberboard (MDF), balsa, poplar, and cedar. The plastic could be, but not limited to: acrylonitrile butadiene styrene (ABS), polycarbonate, nylon, polyethylene terephthalate (PET), and polyethylene. Plastic fabrication can be, but not limited to, injection molding, extruding, and machining.

The base sheet 106 is fastened to the elongated body 102 with a cyanoacrylate ester. The cyanoacrylate ester is spread over the entire area of the base sheet 106 that contacts the base surface 104. Similarly, the top sheet 108 and the primary end sheet 112 are fastened to their respective surfaces with a cyanoacrylate ester spread over their respective areas that contact their respective surfaces on the elongated body 102. However, the base sheet 106, the top sheet 108, and the primary end sheet 112 could also be fastened by various glues, adhesives or epoxies, staples, nails, snaps, tongue and groove, hook and loop fasteners, etc.

The base sheet 106, the top sheet 108 and the primary end sheet 112 are comprised of rubber sheet approximately 1/16 inches thick. The base sheet 106, the top sheet 108 and the primary end sheet 112 could be 1/32, 1/8, 1/4, 3/8, or 1/2 inches thick. The base sheet 106, the top sheet 108 and the primary end sheet 112 could be 1/64 to 3/4 inches thick. However, the base sheet 106, top sheet 108, and primary end sheet 112 could also be comprised of any flexible sheeting. This flexible sheeting could be an open cell sheet material, a closed cell sheet material, a solid rubber sheet material, plastic sheet, or cork. Some open cell sheet materials are, but not limited to: polyether, polyester, high density urethane. Some closed cell sheet materials are, but not limited to: silicone, nitrile, viton. Some solid rubber plastic sheet materials are, but not limited to: neoprene, butyl, flourosilicone. One type of flexible plastic sheet could be vinyl. The base sheet 106, top sheet 108, and primary end sheet 112 could also be comprised of textile cloth made from wool, cotton, nylon, polyester, or other materials. The top sheet 108 could be comprised of a stiff material shaped as an upside down "U". The stiff material version of the top sheet 108 would fit snugly over the curved surface 100. The stiff material could be, but not limited to, any of the stiff materials listed previously in the first embodiment. The base sheet 106 and/or top sheet 108 could be co-extruded with the elongated body 102. The base sheet 106, top sheet 108, and/or primary end sheet 112 could be formed with the elongated body 102 as one piece with a two shot mold.

The width of the small profile of the elongated body 102 could also be approximately 1 3/8 inches, 1 3/4 inches, 10 millimeters, 35 millimeters, 40 millimeters, 45 millimeters, 50 millimeters, 70 millimeters, or 90 millimeters. The width of the small profile of the elongated body 102 could range from 10 to 90 millimeters. The width of the small profile of the elongated body 102 should be approximately equal to the thickness of a door 112. Different doors 112 can have different thicknesses. The height of the small profile of the elongated body 102 could also be approximately 11/16 inches, 7/8 inches, 5 millimeters, 17.5 millimeters, 20 millimeters, 22.5 millimeters, 25 millimeters, 35 millimeters, or 45 millimeters. The height of the small profile of the elongated body 102 could range from 5 millimeters to 45 millimeters. The proportion of width to height of the small profile of the elongated body 102 could be approximately 0.29, 1/2, 3/4, 1, 2, 4, 6, 10, 14, or 18. The proportion of width to height of the small profile of the elongated body 102 could range from 0.29 to 18. The length of the elongated body 102 could be approximately 12, 18, 24, 30, 36, 42, 48, 54, or 60 inches. The length of the elongated body 102 could range from 12 to 60 inches.

Figure 5:
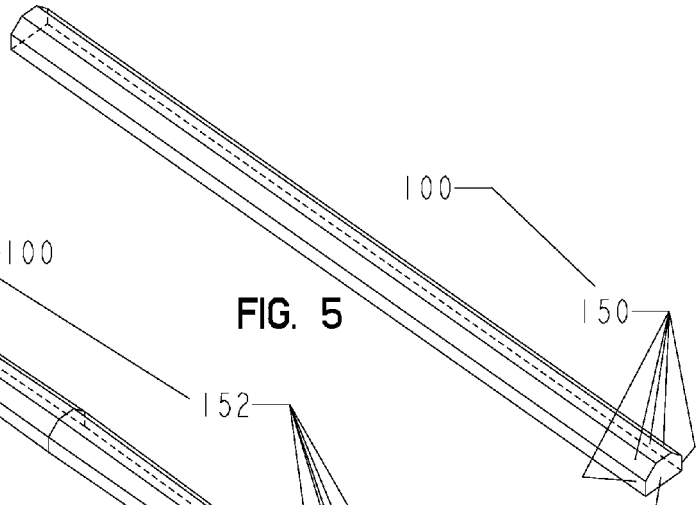
FIG. 5 is a perspective view of a variation of one part of the exercise device.

The curved surface 100 can be comprised of 5 flat surfaces 150 (FIG. 5). Five equal length straight lines replace the generally curved edge on the small profile. The five equal length straight lines are connected at their ends. The ends of the five equal length lines are on the replaced generally curved edge. The small profile is extruded. The five equal length straight lines on the extruded profile become the 5 flat surfaces 150. The curved surface 100 can also be comprised of 2, 3, 4, 10, 20, 50, 100, 500, or 1000 flat surfaces 150. The curved surface 100 can be comprised of a range of flat surfaces 150 from 2 to 1000. The equal length straight lines replacing the generally curved edge could be unequal lengths. The flat surfaces 150 comprising the curved surface 100 could also have curvature.

Figure 6:
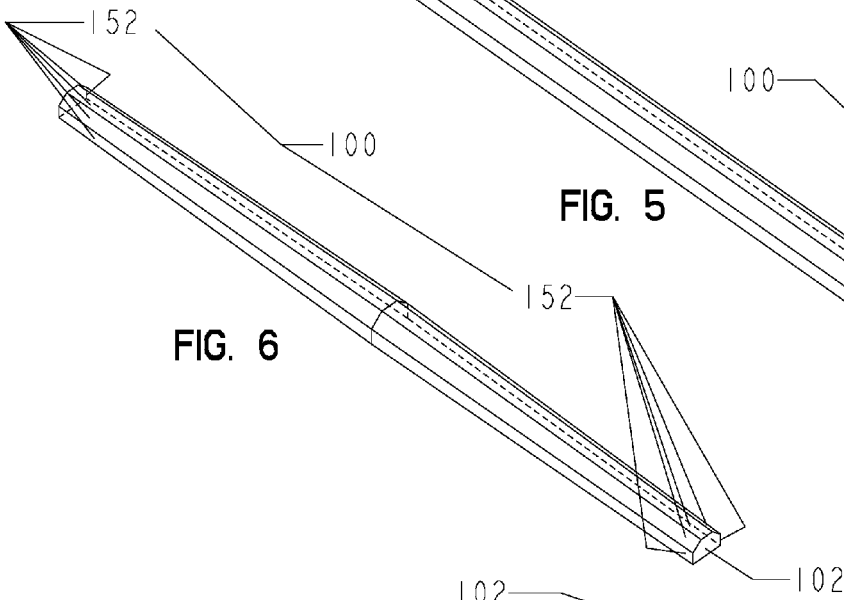
FIG. 6 is a perspective view of another variation of one part of the exercise device.

The curved surface 100 can be comprised of 10 small surfaces 152 (FIG. 6). The small surfaces 152 join at their edges to form a contiguous surface. The small surfaces 152 are flat. The small profile has 6 generally straight edges. The first edge is vertical. The second edge starts at the top of the first edge. The second edge runs up and to the right. The second edge is about 45 degrees from horizontal. The third edge starts at the upper right end of the second edge. The third edge runs approximately horizontal to the right. The fourth edge starts at the right end of the third edge. The fourth edge runs down and to the right. The fourth edge is approximately 45 degrees from horizontal. The fifth edge starts at the lower right end of the fourth edge. The fifth edge runs down. The fifth edge is approximately vertical. The sixth edge starts at the lower end of the fifth edge. The sixth edge runs horizontally to the left. The sixth edge terminates at the lower end of the first edge. The first, second, third, fourth, and fifth edges are approximately equal in length.

The small profile is extruded. As the profile extrudes, the first, second, third, fourth, and fifth edges linearly scale up through half the length of the pull-up device 20. At this point, the first, second, third, fourth, and fifth edges of the extruded small profile has formed 5 out of 10 small surfaces 152. As the profile extrusion continues to the end of the pull-up device 20, the first, second, third, fourth, and fifth edges linearly scale down. Now, the first, second, third, fourth, and fifth edges of the extruded small profile has formed the remaining 5 small surfaces 152.

The shape and size at the beginning and end of the extruded small profile are approximately the same. The height and width at the beginning and end of the extruded small profile can be the same values listed before for the small profile. The height and width at the midpoint of the extruded small profile can be 5, 10, 15, 20, 25, 30, 35, 40, 45, and 50 percent greater than at the beginning or end of the extruded small profile. The height and width at the midpoint of the extruded small profile can range from 0.5 to 1000 percent greater than the beginning or end of the extruded small profile. The height at the midpoint of the extruded small profile can be 0.1, 0.2, 0.3, 0.5, 1, 2, 3, 4, 5, and 10 inches greater than the height at the beginning or end of the extruded small profile. The height at the midpoint of the extruded small profile can range from 0.005 to 10 inches greater than the height at the beginning or end of the extruded small profile. The width at the midpoint of the extruded small profile can be 0.1, 0.2, 0.3, 0.5, 1, 2, 3, 4, 5, and 10 inches greater than the width at the beginning or end of the extruded small profile. The width at the midpoint of the extruded small profile can range from 0.005 to 10 inches greater than the width at the beginning or end of the extruded small profile.

Additionally, the curved surface 100 can be comprised of varying numbers, shapes, and sizes of small surfaces 152. The curved surface 100 can be comprised of 2, 3, 4, 5, 10, 15, 20, 25, 50, 100, 1000, or 10,000 small surfaces 152. The curved surface 100 can be comprised of 2 to 50,000 small surfaces 152. The small surfaces 152 can have curvature. The edges of the small surfaces 152 can have curvature. Each small surface 152 can have 3, 4, 5, 6, 8, 10, 15, 20, 50, 100, 1000, or 5000 edges. Each small surface 152 can have 3 to 10,000 edges. A number of small surfaces 152, each with their own number of edges and curvature can comprise the curved surface 100.

Figure 7:
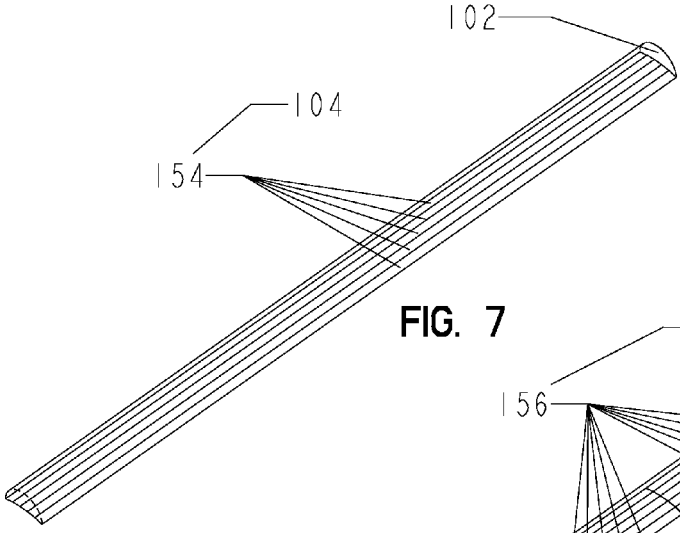
FIG. 7 is a perspective view of an additional variation of one part of the exercise device.

The base surface 104 can be comprised of 5 planar surfaces 154 (FIG. 7). Five equal length straight lines replace the generally straight edge on the small profile. The five equal length straight lines are connected at their ends. The first equal length straight line starts on the left end of the generally curved edge. The first equal length straight line forms to the right approximately 15 degrees above the horizontal. The second equal length straight line starts at the right end of the first equal length straight line. The second equal length straight line forms to the right approximately 7 degrees above the horizontal. The third equal length straight line starts at the right end of the second equal length straight line. The third equal length straight line forms horizontally to the right. The fourth equal length straight line starts at the right end of the third equal length straight line. The fourth equal length straight line forms to the right approximately 7 degrees below the horizontal. The fifth equal length straight line starts at the right end of the fourth equal length straight line. The fifth equal length straight line forms to the right approximately 15 degrees below the horizontal. The fifth equal length straight line ends on the right end of the generally curved edge. The small profile is extruded. The five equal length straight lines on the extruded profile become the 5 planar surfaces 154. The base surface 104 can also be comprised of 2, 3, 4, 10, 20, 50, 100, 500, or 1000 planar surfaces 154. The base surface 104 can be comprised of a range of planar surfaces 154 from 2 to 1000. The equal length straight lines replacing the generally curved edge could be unequal lengths. The planar surfaces comprising the base surface 104 could also have curvature.

Figure 8:
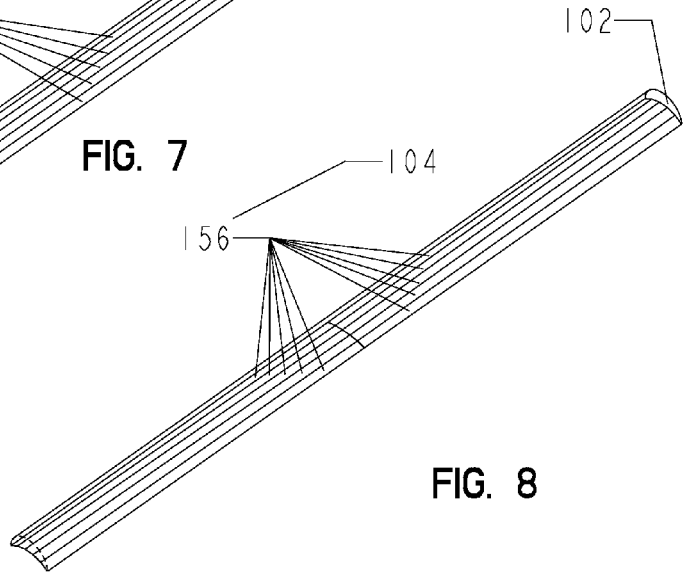
FIG. 8 is a perspective view of another variation of one part of the exercise device.

The base surface 104 can be comprised of 10 lesser surfaces 156 (FIG. 8). The lesser surfaces 156 join at their edges to form a contiguous surface. The lesser surfaces 156 are flat. The small profile has 5 generally straight edges connected to the generally curved edge. The first straight edge starts on the left end of the generally curved edge. The first straight edge forms up and to the right. The first straight edge is approximately 15 degrees above the horizontal. The second straight edge starts at the right end of the first straight edge. The second straight edge runs up and to the right. The second straight edge is approximately 7 degrees above horizontal. The third straight edge starts at the right end of the second straight edge. The third straight edge runs approximately horizontal to the right. The fourth straight edge starts at the right end of the third straight edge. The fourth straight edge runs down and to the right. The fourth straight edge is approximately 7 degrees below horizontal. The fifth straight edge starts at the right end of the fourth straight edge. The fifth straight edge runs down and to the right. The fifth edge is approximately 15 degrees below horizontal. The fifth straight edge ends at the right end of the generally curved edge. The first, second, third, fourth, and fifth straight edges are approximately equal in length.

The small profile is extruded. As the profile extrudes, the first, second, third, fourth, and fifth straight edges linearly scale up vertically through half the length of the pull-up device 20. At this point, the extruded small profile has formed 5 out of 10 lesser surfaces 156. As the profile extrusion continues to the end of the pull-up device 20, the first, second, third, fourth, and fifth straight edges linearly scale down vertically. Now, the extruded small profile has formed the remaining 5 lesser surfaces 156.

The shape and size at the beginning and end of the extruded small profile are approximately the same. The height and width at the beginning and end of the extruded small profile can be the same values listed before for the small profile. The height of the third straight edge from the bottom of the small profile at the midpoint of the extruded small profile can be 5, 10, 15, 20, 25, 30, 35, 40, 45, and 50 percent greater than at the beginning or end of the extruded small profile. The height of the third straight edge from the bottom of the small profile at the midpoint of the extruded small profile can range from 0.5 to 1000 percent greater than at the beginning or end of the extruded small profile. The height of the third straight edge from the bottom of the small profile at the midpoint of the extruded small profile can be 0.1, 0.2, 0.3, 0.5, 1, 2, 3, 4, 5, and 10 inches greater than the height at the beginning or end of the extruded small profile. The height of the third straight edge from the bottom of the small profile at the midpoint of the extruded small profile can range from 0.005 to 10 inches greater than the height at the beginning or end of the extruded small profile. The first, second, third, fourth, and fifth straight edges are always below the generally curved edge.

Additionally, the base surface 104 can be comprised of varying numbers, shapes, and sizes of lesser surfaces 156. The base surface 104 can be comprised of 2, 3, 4, 5, 10, 15, 20, 25, 50, 100, 1000, or 10,000 lesser surfaces 156. The base surface 104 can be comprised of 2 to 50,000 lesser surfaces 156. The lesser surfaces 156 can have curvature. The edges of the lesser surfaces 156 can have curvature. Each lesser surface 156 can have 3, 4, 5, 6, 8, 10, 15, 20, 50, 100, 1000, or 5000 edges. Each lesser surface 156 can have 3 to 10,000 edges. A number of lesser surfaces 156, each with their own number of edges and curvature can comprise the base surface 104.

The primary end 110 and the secondary end 114 can be composed of multiple surfaces. These surfaces can be flat or curved.

Figure 9:
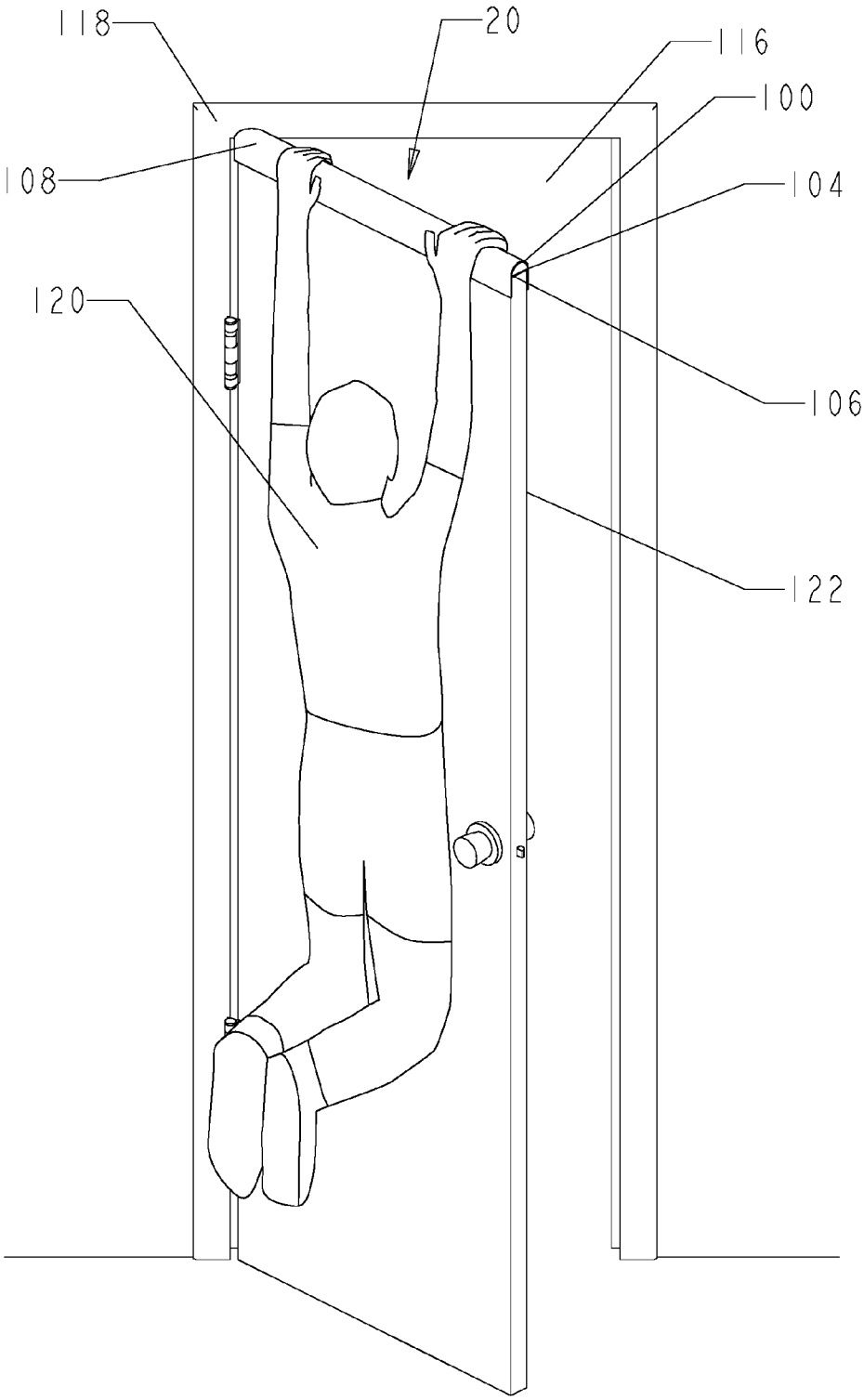
FIG. 9 is a perspective view of the exercise device of FIG. 1 shown installed on a door.
Figure 10:
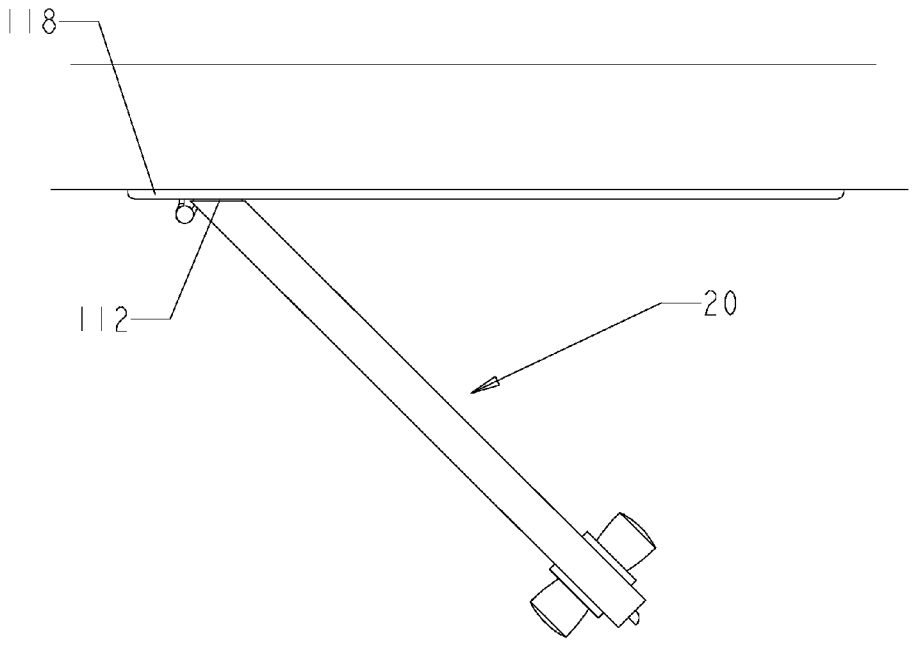
FIG. 10 is a top orthographic view of the exercise device of FIG. 1 shown installed on a door.

Operation—FIGS. 9 and 10

The exercise device 20 is assembled on top of the partially open door 122. Approximately all of the base sheet 106 contacts the top of the door 122. The overhanging parts of the top sheet 108 hang off on either side of the door 122. The door 122 is attached to a doorway 116. The primary end sheet 112 is flush with an upper sill 118 of the doorway 116.

The user 120 grips the area of the top sheet 108 that is directly fastened to the curved surface 100. The user 120 can entirely support their weight with their hands. Then, the user 120 pulls themselves up until the user's 120 chin is above the exercise device 20. Then the user 120 straightens his or her arms to hang from the exercise device 20. This can be repeated multiple times. The user 120 can also just hang from the exercise device 20.

FIGS. 11-18

Additional Embodiments

Additional embodiments are shown in FIGS. 11-13, FIGS. 14-15, and FIGS. 16-18.

Figure 11:
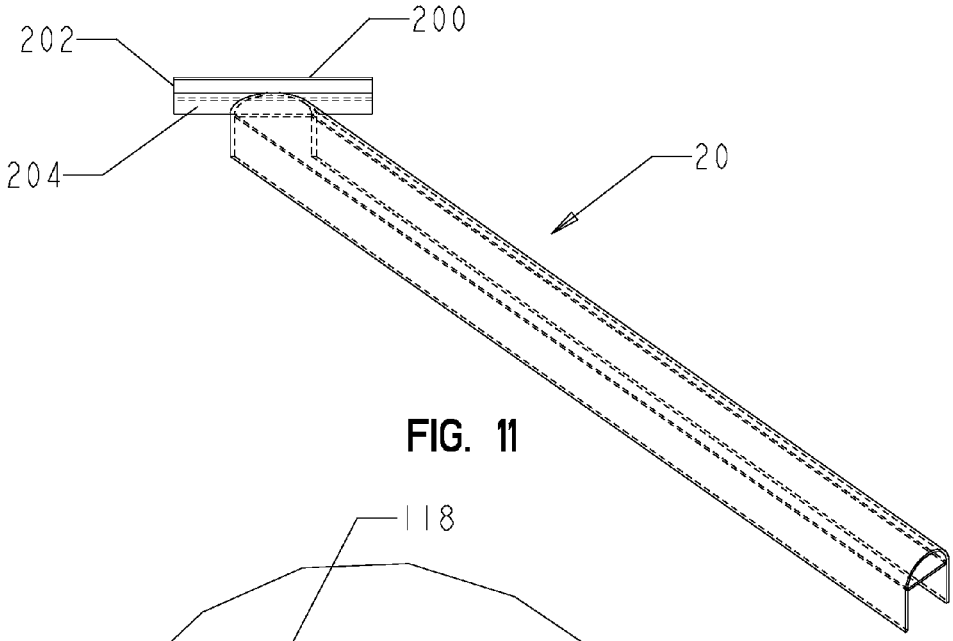
FIG. 11 is a perspective view of another embodiment of the exercise device.
Figure 12:
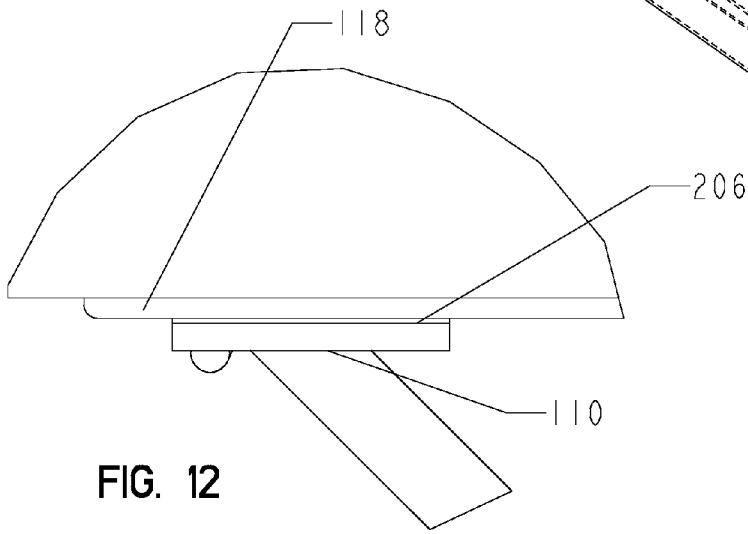
FIG. 12 is a partial top orthographic view of the exercise device in FIG. 11 shown installed on a door.
Figure 13:
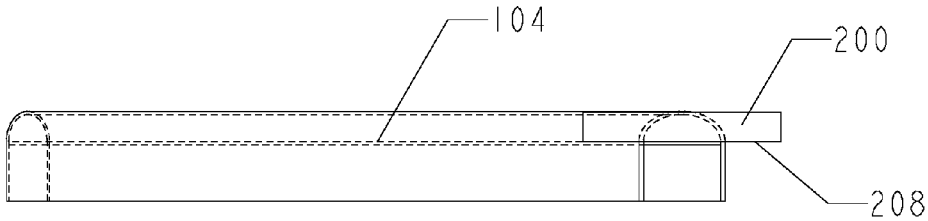
FIG. 13 is a side orthographic view of the exercise device of FIG. 11.

A second embodiment in FIGS. 11-13 is the same of the first embodiment except for the following differences. The primary end sheet 112 is replaced with an elongated member 202 and an elongated member sheet 200. The elongated member 202, which is approximately 4¾×0.75×0.65 inches, is fastened to the primary end with wood glue. A mating surface 204 on the elongated member 202 is approximately centered on the primary end 110 lengthwise. The bottom surface 208 on the elongated member 202 is approximately flush with the base surface 104 of the elongated body 102. The elongated member sheet 200 is fastened with a cyanoacrylate ester to a far surface 206 of the elongated member 202. The elongated member sheet 200 approximately covers all of the far surface 206.

In this embodiment, the elongated member 202 is comprised of wood. However, the elongated member 202 can be comprised of any stiff material. Some stiff materials are listed in the first embodiment. The elongated member sheet 200 could also be fastened by glues, adhesives or epoxies, staples, nails, snaps, tongue and groove, hook and loop fasteners, etc. The elongated member sheet 200 is comprised of rubber sheet approximately 1/16 inches thick. However, the elongated member sheet 200 could also be comprised of, but not limited to, any material listed for the top sheet 108 in the first embodiment. The elongated member sheet 200 could range in thickness from 1/32 to ½ inches.

Operation is the same as the first embodiment except that the elongated member sheet 200 is flush with the upper sill 118 instead of the primary end sheet 112.

Figure 14:
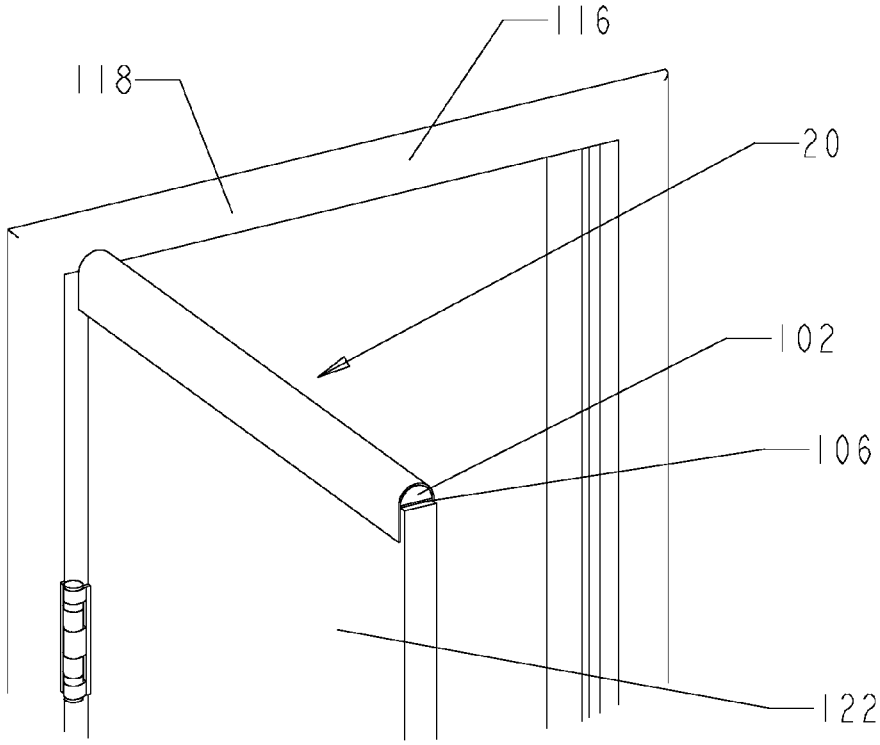
FIG. 14 is a perspective view of the exercise device shown installed on a door in accordance with an additional embodiment.
Figure 15:
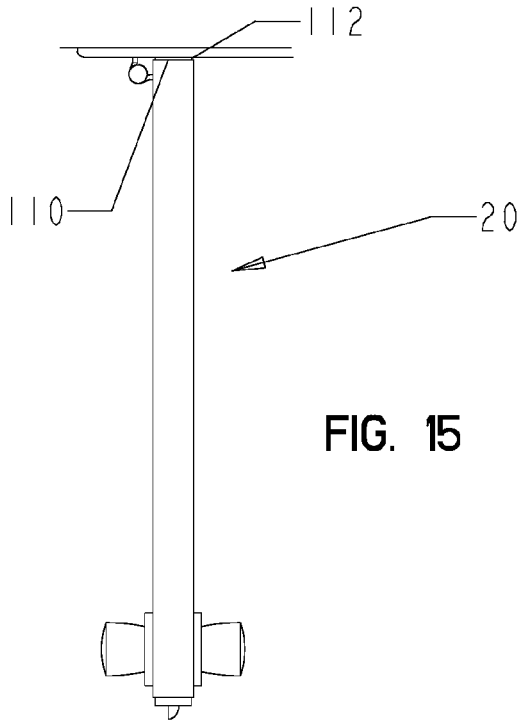
FIG. 15 is a top orthographic view of the exercise device of FIG. 14 shown installed on a door.

A third embodiment in FIGS. 14-15 is the same as the first embodiment except the primary end 110 is cut approximately parallel to the small profile of the elongated body 102. Also the primary end 110 is approximately normal to the base surface 106.

Operation is the same as the first embodiment.

Figure 16:
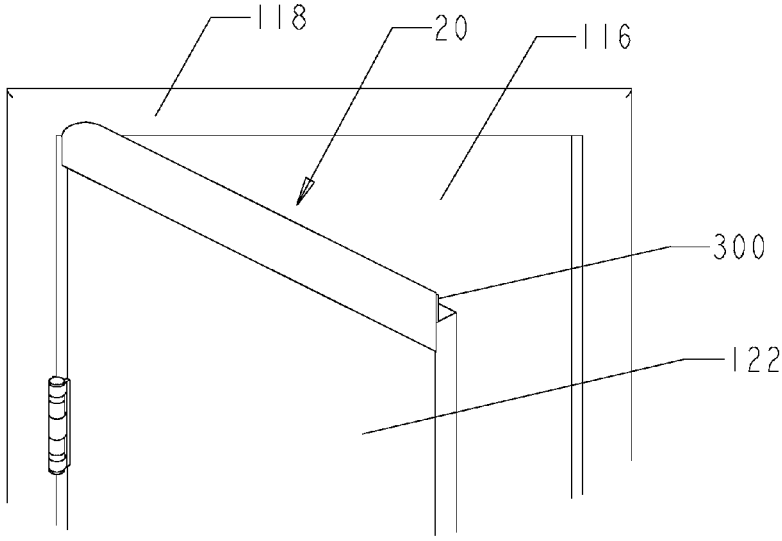
FIG. 16 is a perspective view of the exercise device shown installed on a door in accordance with another additional embodiment.
Figure 17:
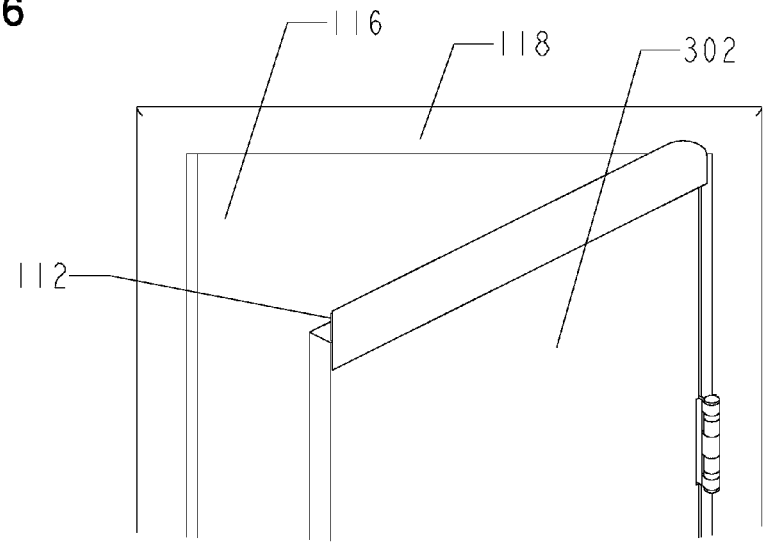
FIG. 17 is a perspective view of the exercise device from FIG. 16 shown installed on a door that is hinged on the opposite side from the door in FIG. 16.
Figure 18:
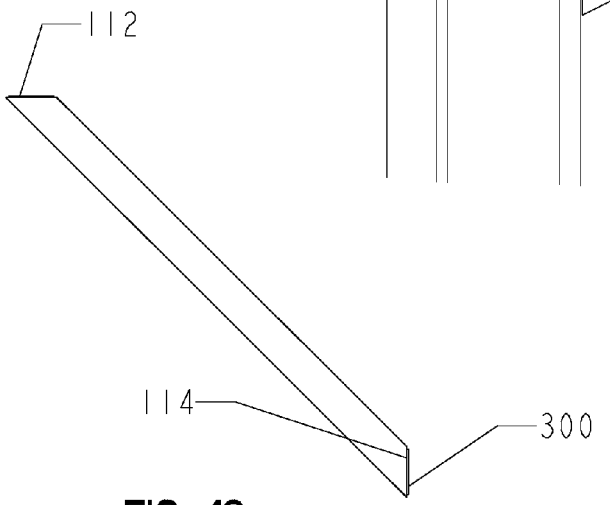
FIG. 18 is a top perspective view of the exercise device from FIG. 16.

A fourth embodiment in FIGS. 16-18 is the same as the first embodiment except for the following differences. The secondary end 114 of the elongated body 102 is cut at approximately a 45° angle to the small profile of the elongated body 102. The primary end 110 and secondary end 114 are approximately normal to each other. The secondary end 114 is approximately normal to the base surface 104 of the elongated body 102. A secondary end sheet 300 is fastened using a cyanoacrylate ester to the secondary end 114. The secondary end sheet 300 approximately covers the secondary end 114. The secondary end sheet 300 could also be fastened by glues, adhesives or epoxies, staples, nails, snaps, tongue and groove, hook and loop fasteners, etc. The secondary end sheet 300 is comprised of, but not limited to, any material listed for the top sheet 108 in the first embodiment. The secondary end sheet 300 could range in thickness from 1/32 to ½ inches.

This embodiment operates the same as the first embodiment as shown in FIG. 16. In addition, this embodiment may operate on an opposite hinged door 302 as shown in FIG. 17. This operation is the same as the first embodiment except that the secondary end sheet 300 is flush against the upper sill 118 instead of the primary end sheet 112.

A fifth embodiment (not shown) is the same as the fourth embodiment except with both the primary end sheet 112 and secondary end sheet 300 replaced with an elongated member 202 and elongated member sheet 200. The primary end sheet 112 and secondary end sheet 300 are replaced in the same manner that the primary end sheet 112 is replaced with an elongated member 202 and elongated member sheet 202 in the second embodiment.

Operation is identical to the fourth embodiment except that the elongated member sheet 200 is flush with the upper sill 118 instead of the primary end sheet 112 or the secondary end sheet 114.

CONCLUSION, RAMIFICATIONS, AND SCOPE

In general regarding the exercise device 20, it may be desirable:

- to use common materials and few parts for easier sourcing and manufacturing. The first embodiment has four parts (elongated body 102, top sheet 108, base sheet 106, and primary end sheet 112) and cyanoacrylate ester. The elongated body 102 comprises a wood dowel cut in half. The top sheet 108, base sheet 106, and primary end sheet 112 comprises a rubber sheet. Typically, wood dowels, rubber sheets, and cyanoacrylate ester are all commonly available.
- to cause very little wear to the supporting structure of the exercise device 20. In all embodiments, rubber sheeting covers any part of the exercise device 20 that contacts the door 122 or top sill 118. Rubber sheeting is a soft material. The door 122 is typically wood or metal. Both of these materials are much harder than rubber sheeting. The top sill 118 is typically wood which is much harder than rubber sheeting. If a soft and hard material rub against each other, most of the wear occurs on the soft material. Since the rubber sheeting is the soft material, it will incur must of the wear. Given this, the rubber sheet will still wear slowly. Additionally, there is little to no rubbing between the exercise device 20 and the support structure. Since rubbing causes wear, there is very little wear in general between the exercise device 20 and the supporting structure.
- to quickly and easily install a device. It takes approximately 10 to 20 seconds to place the exercise device 20 on top of an open door 20. It takes approximately another 5 to 10 seconds to slide the exercise device 20 along the top of the door 20 such that the primary end sheet 112, secondary end sheet 300, or elongated member sheet 200 entirely contacts the upper sill 118. Therefore, installation takes approximately 15 to 30 seconds. This is typically a short amount of time to install a device. Installation comprises two coarse linear actions of placing the exercise device 20 on top of the door 122 and sliding the exercise device 20 along the top of the door 122. Generally, coarse actions and few steps make procedures easier.
- to quickly and easily un-install a device. It takes approximately 10 to 20 seconds to pull the exercise device 20 off the top of the door 122. Therefore, it takes approximately 10 to 20 seconds to un-install the exercise device 20. This is typically a short amount of time to un-install an exercise device. Installation comprises one coarse linear action of moving the exercise device 20 up off the top of the door 122. Generally, coarse actions and few steps make procedures easy.
- to allow minimal movement of the support structure of the exercise device 20. The primary end sheet 112, secondary end sheet 300, or elongated member sheet 200 of the exercise device 20 is up against the upper sill 118. The user's 120 weight keeps the exercise device 20 from sliding on the door 122. Therefore, the primary end sheet 112, secondary end sheet 300 or elongated member sheet 200 surface touching the upper sill 118 will allow approximately 2 to 5° maximum movement of the door while the user's 120 weight is on the exercise device 20.

to promote avoidance of pinch points for the user 120. The top sheet 108 that overhangs the curved surface 100 of the exercise device 20 on both long ends covers the mating surface gap between the door 122 and exercise device 20. Therefore, as long as the top sheet 108 overhangs the door 122, the user 120 will avoid pinching their hands between the exercise device 20 and the door 122 while hanging or performing pull-ups.

to promote easy storage of a device. The first embodiment is approximately 1½×¾×24 inches. This is a long thin form that can lean in the corner of a closet. It is typically an easy action to place the exercise device 20 in the corner of a closet.

to promote easy transportation of a device. The first embodiment is approximately 1½×¾×24 inches. Any suit case or backpack which has an internal pocket 24 inches or longer would accommodate the exercise device. The exercise device 20 would fill a small area of the suit case or backback since the other dimensions of 1½ inches×¾ inches would be small relative to the suitcase or backpack. The first embodiment weights approximately 1 to 2 pounds. This small amount of weight would be easier for the user 120 to carry.

Although the description above contains many specificities, these should not be construed as limiting the scope of the embodiments but as merely providing illustrations of several embodiments. Additionally, although the embodiments are numbered, this does not indicate any preference for any one of them over the other.

Thus the scope of the embodiments should be determined by the appended claims and their legal equivalents, rather than by the examples given.

I claim:

1. An exercise device comprising: (a) an elongated body, having a base surface and a curved surface, (b) said curved surface having a curving surface; wherein said user can place said base surface of said elongated body on top of an open door such that the majority of said elongated body is directly above the top of said door, both a longitudinal axis of said elongated body and a longitudinal axis of said curved surface run generally parallel to a longitudinal axis of the top of said door, and the top of said door remains substantially horizontal with respect to a ground surface or a floor as said door swings; a movable top sheet fastened to said curved surface such that it can hang below the top of said door; and whereby said user can hang or perform pull-ups while gripping with both hands said curved surface of said elongated body with promotion of avoidance of cutting, damaging, or injuring the hands of said user on the sharp ends of said door.

2. The exercise device of claim 1, further including a base sheet fastened to the base surface of said elongated body.

3. The exercise device of claim 1, further including a primary end sheet fastened to a primary end of said elongated body.

4. The exercise device of claim 1 wherein said elongated body is made of wood.

5. The exercise device of claim 2 wherein said base sheet is made of rubber sheet.

6. The exercise device of claim 1 wherein said top sheet is made of rubber sheet.

7. The exercise device of claim 1 wherein said top sheet is made of flexible closed cell sheet.

8. The exercise device of claim 1 wherein said base surface comprises a substantially flat surface.

9. The exercise device of claim 1 wherein said curved surface comprises an extruded semicircle surface.

10. The exercise device of claim 3 wherein said primary end is approximately normal to said base surface and approximately normal to the longitudinal axis of said elongated body.

11. An exercise device comprising:

(a) an elongated body, having a base surface, a curved surface and a primary end, (b) a base sheet, (c) a top sheet, (d) a primary end sheet, (e) fastening means for said base sheet to said base surface of said elongated body, (f) fastening means for said top sheet to said curved surface of said elongated body, (g) fastening means for said primary end sheet to said primary end of said elongated body, (h) said curved surface having a curving surface;

wherein said user can place said base sheet on top of an open door such that the majority of said elongated body is directly above the top of said door, both a longitudinal axis of said elongated body and a longitudinal axis of said curved surface run generally parallel to a longitudinal axis of the top of said door, and the top of said door remains substantially horizontal with respect to a ground surface or a floor as said door swings;

whereby said user can hang or perform pull-ups while gripping with both hands an area of said top sheet directly contacting said curved surface of said elongated body with promotion of avoidance of cutting, damaging, or injuring the hands of said user on the edges of said door.

12. The exercise device of claim 11 wherein said base sheet is made of rubber sheet.

13. The exercise device of claim 11 wherein said top sheet is made of rubber sheet.

14. The exercise device of claim 11 wherein said primary end sheet is made of rubber sheet.

15. The exercise device of claim 11 wherein said primary end sheet is made of flexible closed cell sheet.

16. The exercise device of claim 11 wherein said top sheet is made of flexible closed cell sheet.

17. The exercise device of claim 11 wherein said fastening means comprises cyanoacrylate ester.

18. The exercise device of claim 11 wherein said primary end comprises a substantially flat surface.

* * * * *